US006393660B1

(12) United States Patent
Lin

(10) Patent No.: US 6,393,660 B1
(45) Date of Patent: May 28, 2002

(54) HANDLE FOR A LUGGAGE

(75) Inventor: Jer Hong Lin, Taipei (TW)

(73) Assignee: Chaw Khong Technology Co., Ltd. (TW)

( * ) Notice: Subject to any disclaimer, the term of this patent is extended or adjusted under 35 U.S.C. 154(b) by 0 days.

(21) Appl. No.: 09/594,825

(22) Filed: Jun. 16, 2000

Related U.S. Application Data

(63) Continuation-in-part of application No. 09/298,921, filed on Apr. 26, 1999, now Pat. No. 6,163,925.

(51) Int. Cl.[7] ..... A45C 7/00

(52) U.S. Cl. ..... 16/113.1; 190/115; 280/655; 280/47.315

(58) Field of Search ..... 16/113.1, 114.1, 16/405, 429; 280/655, 655.1, 47.315, 47.317; 190/115, 18 A

(56) References Cited

U.S. PATENT DOCUMENTS

| | | | | | |
|---|---|---|---|---|---|
| 4,256,320 | A | * | 3/1981 | Hager | 190/18 A |
| 5,613,273 | A | * | 3/1997 | Tsia | 16/113.1 |
| 5,624,012 | A | * | 4/1997 | Wang | 16/113.1 |
| 5,692,266 | A | * | 12/1997 | Tsia | 16/113.1 |
| 5,996,177 | A | * | 12/1999 | Cheng | 16/113.1 |

* cited by examiner

*Primary Examiner*—Chuck Y. Mah
(74) *Attorney, Agent, or Firm*—Troxell Law Office PLLC

(57) ABSTRACT

The present invention relates to an improved handle for a luggage that the locking button of the retractable handle is disposed on the top center of the handle. The top surface of the handle is an arch shape with slope from one side to the other. The protrudent height of the button is flush with the higher side of the slope, so that the button will not be actuated unintentionally and the towing tubes will not be retracted unexpectedly when the handle is held while pulling or pushing the luggage.

7 Claims, 6 Drawing Sheets

HANDLE FOR A LUGGAGE

This is continuation-in-part of U.S. patent application Ser. No. 09/298,921, filed on Apr. 26, 1999 in the name of Jer Hong LIN entitled "An Improved Handle for a Luggage". The above application is now U.S. Pat. 6,163,925.

BACKGROUND OF THE INVENTION

The present invention relates to an improved handle for a luggage and more particularly to an improvement of the handle structure. The improvement is made such that the locking button of the luggage will not be actuated unintentionally when the handle of the luggage is held and the luggage is being pulled or pushed by a hand.

Usually, while carrying a luggage, the wheels and the retractable handles are mounted at the bottom and at the top of the luggage respectively, so that the loads exerted on the arms can be reduced if the luggage is loaded heavily. Most of luggages in use now-a-days are the towing type, as described in U.S. Pat. No. 5,566,798 "TRUNK WITH A CONCEALABLE RETRACTABLE HANDLE".

In these patents, the buttons on the handles always protrude some height over the top of handles. A typical handle of a general luggage is shown in FIGS. 5–8.

As shown in FIG. 5, most of the buttons which are located on the handles 21 of the towing rods 20 protrude some height over the handle surface. The side view of FIG. 5 is shown in FIG. 6 in which the button 210 is disposed exactly at the center of the handle 21. On the top of the handle, there are two edges 211, 212, with angles located at both side of the button 210. When the handle is held, the fingers face downwards and the palm faces the edges 211, 212, of the top surface. As a result, the button 210 is pressed with fully contact. It is well noticeable that the button 210 is the vital part in controlling the towing rod to extend or retract. When the towing rods are in their extended position, pressing the button will make the towing rods retracted. When a luggage is being pulled (shown in FIG. 7) or pushed (shown in FIG. 8), the holding palm is in a full contact with the button 210 and may apply a force on the button 210 unavoidably. This causes the button to actuate and consequently causes the retractable inner rods to be pushed into outer rods unexpectedly. Therefore it is very inconvenient in using such luggage because of this defect.

SUMMARY OF THE INVENTION

The primary object of the present invention is to improve the defect of the conventional handle mentioned above and provide an improved handle for a luggage.

Another object of the present invention is to provide an improved handle for a luggage that the locking button of the handle is disposed on the top of the handle with an oblique arch face. When the handle is held and applied a force, the button will not be actuated by accident and the handle will stay in the normal operation.

The other object of the present invention is to provide a handle of a luggage with improvement in that the top surface of the handle is oblique arch, namely, one end is higher than the other. This prevents the locking button from accidentally triggering when the handle is held tightly with a palm.

In order to fulfill the above objects of the present invention, a handle of a luggage in the present invention comprising: a handle; a pair of retractable inner tubes disposed under the handle; a brace attached to the top of a luggage; a pair of outer tubes disposed under the brace; a bracket disposed under the outer tubes; wherein an upper arch portion of the handle near a central top surface of a button occupys a first side portion of top surface and a lower arch portion of the handle near the central top surface of the button occupys a second side portion of top surface, the top surface of the button being located between the said first portion and said second portion top surfaces and the top surface of the button is flush with the arch portion which interconnects the upper and the lower arch surface, when the handle is held and applied a force by palm, there is not any force applied on the top surface of the button and the button can be prevented from being actuated incorrectly.

These and other objects, advantages and novel features of the invention will become more apparent from the following detailed description when taken in conjunction with the accompanying drawings.

DETAILED DESCRIPTION OF PREFERRED EMBODIMENTS

Figure 1:
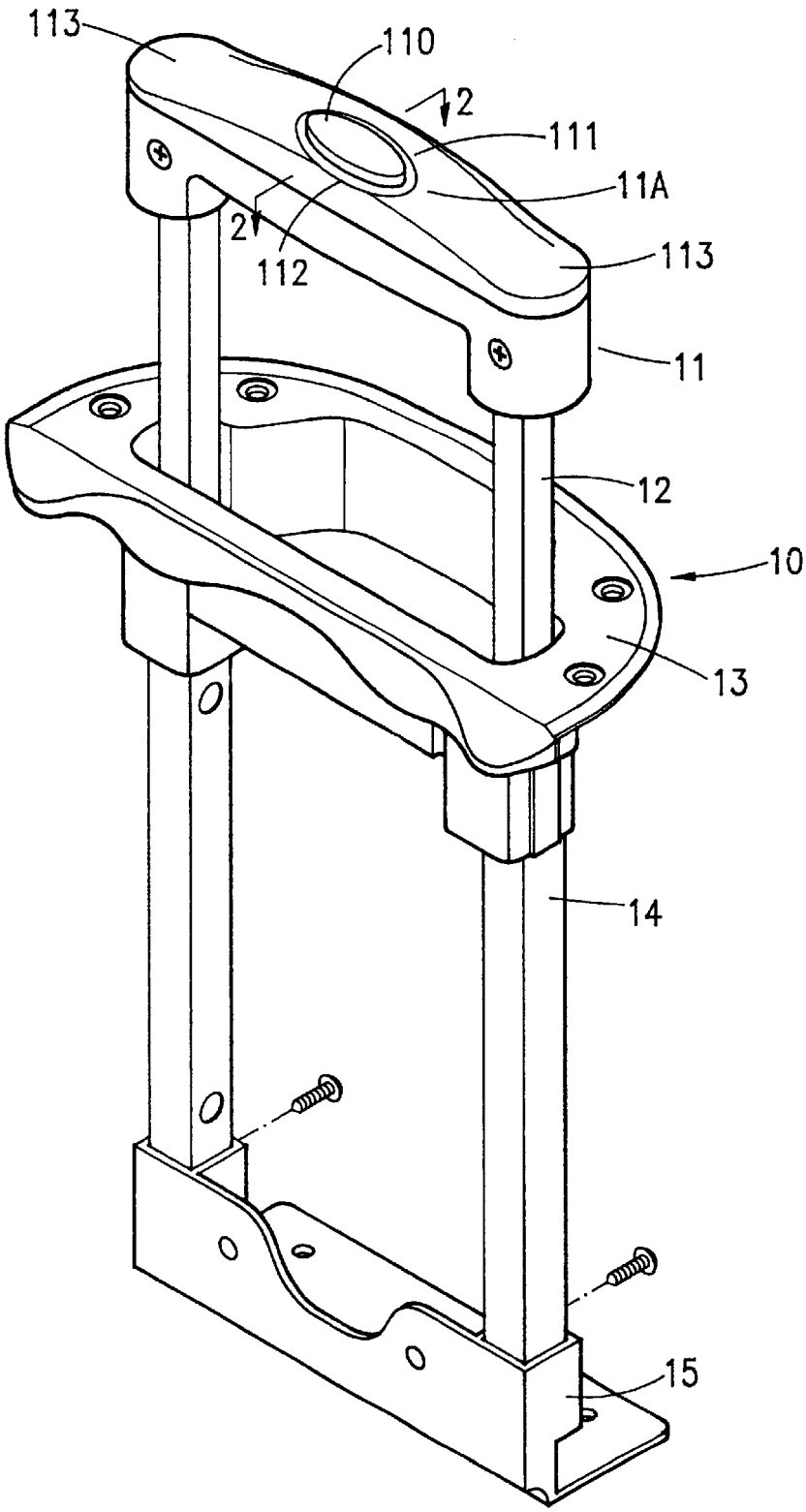
FIG. 1 is a perspective view of the retractable handle assembly in accordance with the present invention. For simplicity, the body of the luggage is omitted.

As shown in FIG. 1, the retractable handle assembly 10 of the present invention comprises a handle 11 with button 110 on top center 111, two retractable inner tubes 12 under the retractable handle 11, a brace 13 which is attached on the luggage, two outer tubes 14 attached under the brace 13, and a bracket 15 attached under the outer tubes 14.

Figure 2:
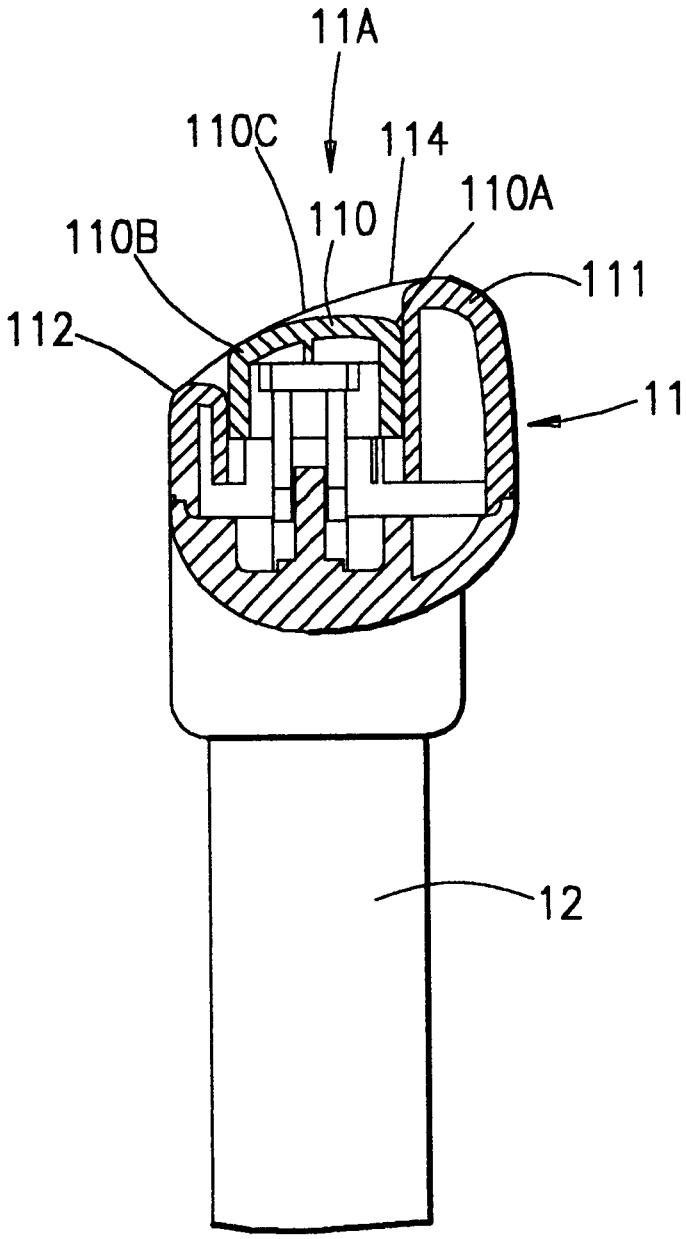
FIG. 2 is the cross section view of the handle in accordance with the present invention, so it shows the clear relationship between the button and the top of the handle.

As shown in FIG. 1, the improvement of the retractable handle 11 of the present invention is that the top center of the handle 11 is formed with a convex arch portion 11 A and both sides of the handle are the lower end of arch portion 113—113. A button 110 is disposed at the top center of the convex arch portion. It is clearly shown in FIG. 2 that the two side of the lateral cross section of the arch portion near the button are not at the same height and the height of the button is preferrably flush with that of the arch portion 11 A of the handle.

The height of right side 110A of the button 110 is higher than that of the left side 110B of the button and the central part 110C is the highest. Considering whole top surface of the handle, the right side 111 of the handle around the button 110 is higher than the left side 112 of the handle. It makes the top surface of the handle to form an oblique surface which is higher in right side and lower in left side and the highest point of the button 110 is located only at the central part 110C.

Figure 3:
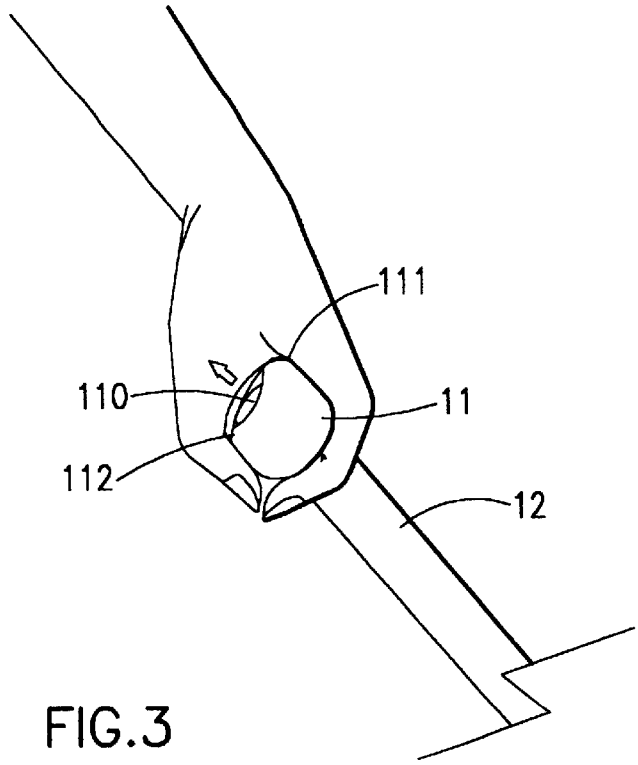
FIG. 3 is a schematic view showing a force-reaction relation between the button and the palm in the present invention when the luggage is pulled.
Figure 4:
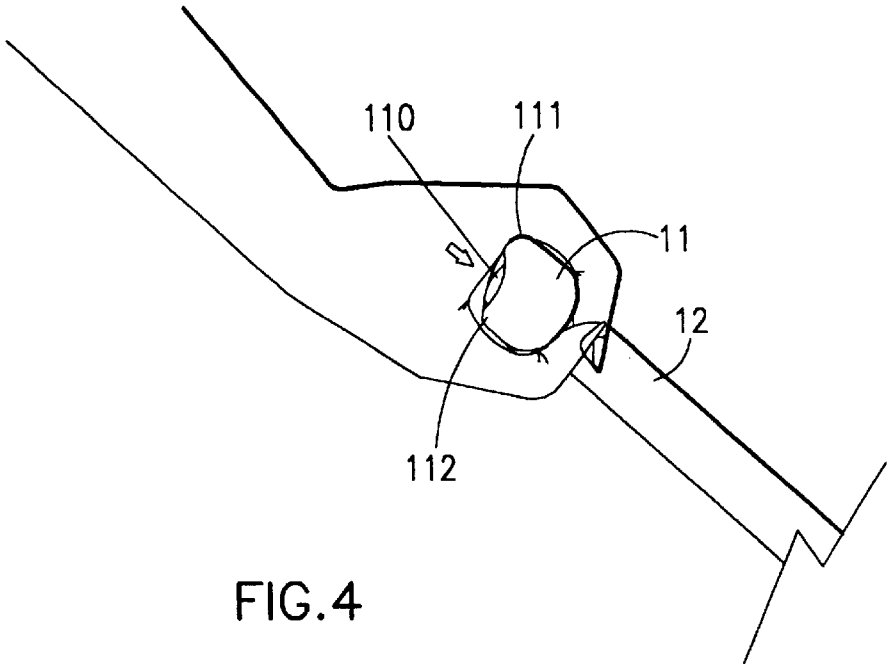
FIG. 4 is a schematic view showing a force-reaction relation between the button and the palm in the present invention when the luggage is pushed.
Figure 5:
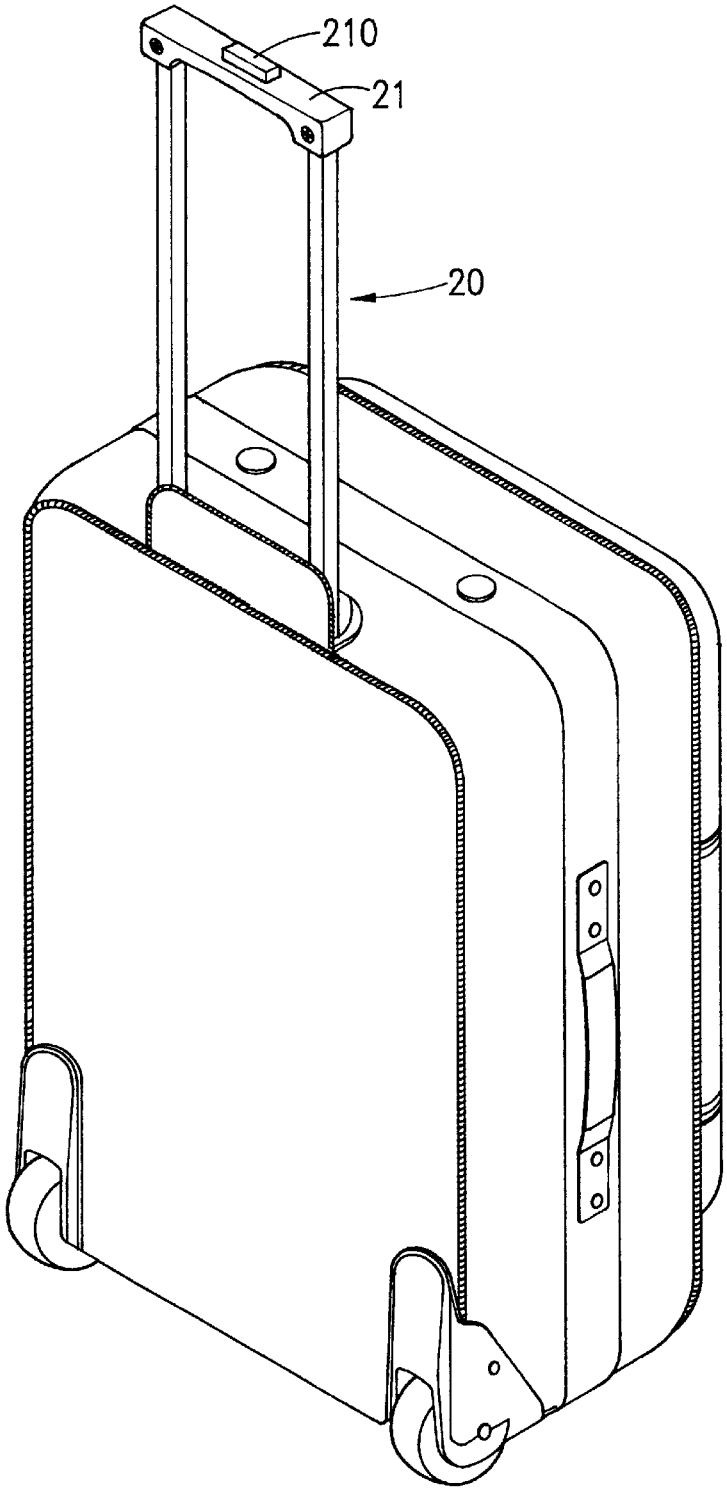
FIG.5(PRIOR ART)
FIG. 5 is a perspective view of a typical luggage with a retractable handle of prior art.
Figure 6:
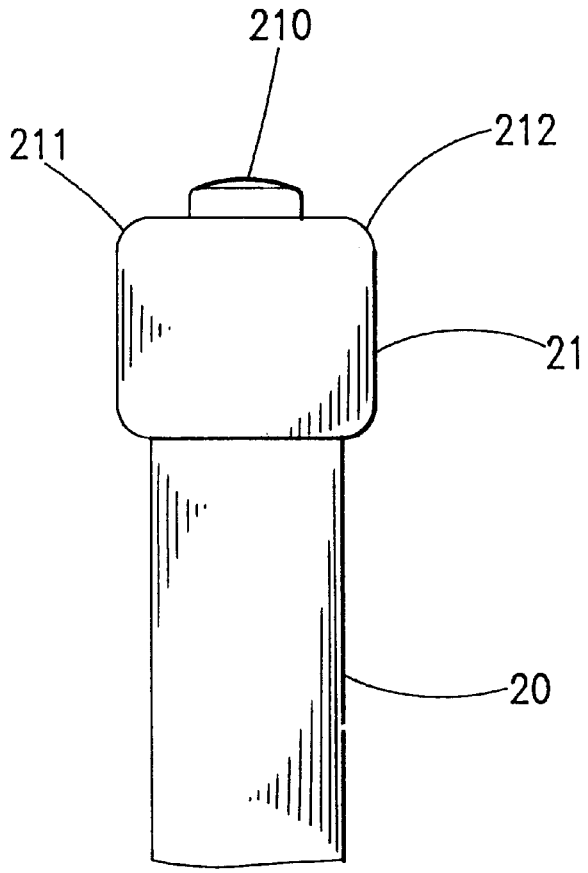
FIG.6(PRIOR ART)
FIG. 6 is a side view of the button on a handle in FIG. 5.
Figure 8:
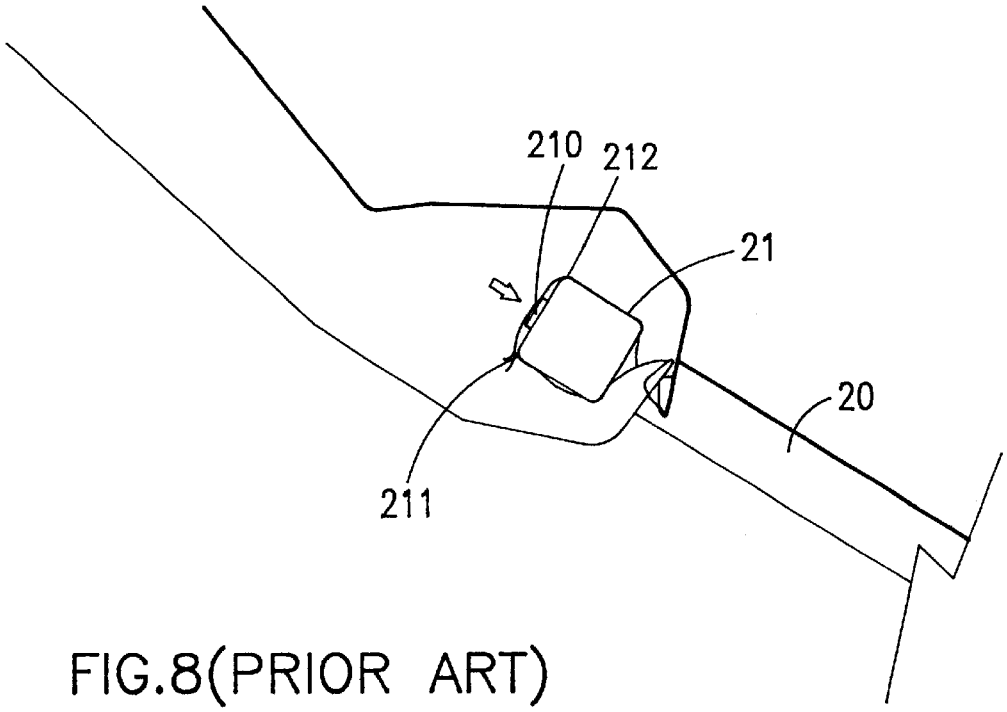
FIG.8(PRIOR ART)
FIG. 8 is a schematic view showing a force-reaction relation between the button and the palm when the luggage in FIG. 5 is pushed.
Figure 7:
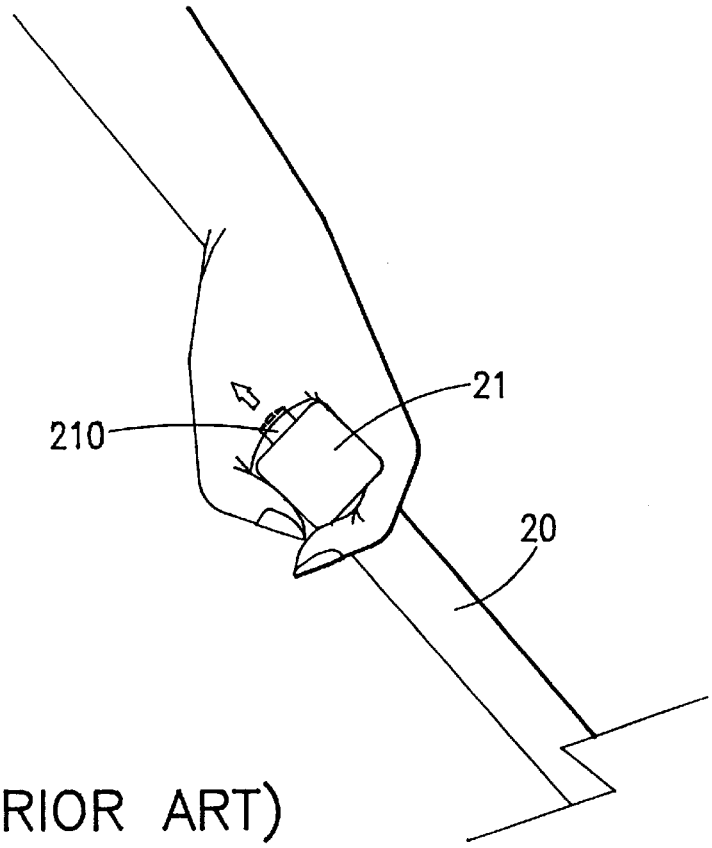
FIG.7(PRIOR ART)
FIG. 7 is a schematic view showing a force-reaction relation between the button and the palm when the luggage in FIG. 5 is pulled.

In other words, near the button 110 of the handle according to the present invention, the right side portion 111 with respect to the button 110 is higher than the left side portion 112 with respect to the button 110 with difference between 1~15 mm as the optimum according to the experimental results. When we move a luggage by pulling or pushing, the force applied by hand can not directly press on the button 110, as shown in FIG. 3 and FIG. 4.

Furthermore, the pom that holds the handle is concave inwards and the central part 110C of the button 110 is unlikely to be contacted. As resulted, the button is also unlikely to be triggered. This is therefore the important feature that is provided by the present invention.

It is to be understood that according to the best mode of the present invention, the button 110 is preferred to disposed eccentrically on the top center of the handle for further preventing the button from being actuated unintentionally when the hand is held while pulling or pushing the luggage.

It is also to be understood that even if the height of the button is a little over the height of a line interconnecting the upper and lower arch surfaces of the handle, when the handle is held and a force is applied by a palm of a user, no triggering force is applied on the button thereby preventing the button from being actuated accidentally.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A handle assembly for luggage in the present invention comprising:

a handle;

a pair of outer tubes; a pair of retractable inner tubes extending from the handle and being slidable within said pair of outer tubes whereby the handle is retractable; and, a locking button movably located on the handle, locking button movement triggering retraction of the handle;

wherein a top surface of the handle has an upper arch portion adjacent a first side of the locking button and a lower arch portion adjacent to a second, opposite side of the locking button whereby, when the handle is held and applied a force by a palm of a user, there is no triggering movement of the button to thereby prevent inadvertent retraction of the handle.

2. The handle for luggage as claimed in claim 1, wherein a top surface of the button is flush with a line interconnecting the upper and the lower arch portions of the handle.

3. The handle for luggage as claimed in claim 1, wherein a top surface of the button is below a line interconnecting the upper and the lower arch portions of the handle.

4. The handle for luggage as claimed in claim 1, wherein a center of the button on the handle is located eccentrically on a top surface of the handle.

5. The handle for luggage as claimed in claim 1, wherein a top surface of the handle is convex.

6. The handle for luggage as claimed in claim 1, wherein a height of the upper arch portion of the handle is larger than that of the lower arch portion by a constant dimension.

7. The handle for luggage as claimed in claim 6, wherein the height of the upper arch portion of the handle is larger than that of the lower arch portion by between 1~15 mm.

* * * * *